US008957293B2

(12) United States Patent
Jolk et al.

(10) Patent No.: US 8,957,293 B2
(45) Date of Patent: Feb. 17, 2015

(54) MUSICAL INSTRUMENT STRING AND PROCESS FOR THE PRODUCTION THEREOF

(71) Applicant: Feindrahtwerk Adolf Edelhoff GmbH & Co. KG, Iserlohn (DE)

(72) Inventors: Ingo Jolk, Ansberg (DE); Mathias Fiolka, Hemer (DE); Gerhard Bürstner, Schwerte (DE); Jörg Liedemann, Iserlohn (DE)

(73) Assignee: Feindrahtwerk Adolf Edelhoff GMBH & Co., Iserlohn (DE)

( * ) Notice: Subject to any disclaimer, the term of this patent is extended or adjusted under 35 U.S.C. 154(b) by 0 days.

(21) Appl. No.: 14/084,948

(22) Filed: Nov. 20, 2013

(65) Prior Publication Data

US 2014/0150626 A1 Jun. 5, 2014

(30) Foreign Application Priority Data

Nov. 30, 2012 (DE) ..... 10 2012 023 530

(51) Int. Cl.
*G10D 3/10* (2006.01)

(52) U.S. Cl.
CPC ..... *G10D 3/10* (2013.01)
USPC ..... 84/297 S

(58) Field of Classification Search
CPC ..... G10D 3/10
See application file for complete search history.

(56) References Cited

U.S. PATENT DOCUMENTS

| | | | | |
|---|---|---|---|---|
| 980,472 | A * | 1/1911 | Zollinger | 84/199 |
| 1,300,112 | A * | 4/1919 | Bowe | 84/297 S |
| 1,617,102 | A * | 2/1927 | Cohn | 84/297 R |
| 2,241,282 | A * | 5/1941 | Wackerle | 84/297 S |
| 3,120,144 | A * | 2/1964 | Bayer | 84/199 |
| 4,333,379 | A * | 6/1982 | Meinel et al. | 84/297 S |
| 4,655,517 | A * | 4/1987 | Bryce | 439/83 |
| 5,801,319 | A * | 9/1998 | Hebestreit et al. | 84/297 S |
| 6,348,646 | B1 * | 2/2002 | Parker et al. | 84/297 R |
| 6,528,709 | B2 * | 3/2003 | Hebestreit et al. | 84/297 S |
| 7,820,897 | B2 * | 10/2010 | Tambara et al. | 84/297 S |
| 8,049,088 | B2 * | 11/2011 | Richter | 84/297 R |
| 8,147,601 | B2 * | 4/2012 | Feldstein et al. | 106/1.22 |
| 8,183,448 | B2 * | 5/2012 | Mueller-Zierach et al. | 84/297 S |
| 8,222,504 | B1 * | 7/2012 | Ball | 84/297 S |
| 8,713,906 | B2 * | 5/2014 | Yaniv et al. | 57/232 |
| 2005/0188813 | A1 * | 9/2005 | Klanner | 84/297 R |
| 2007/0084329 | A1 * | 4/2007 | Allen et al. | 84/452 R |
| 2014/0041506 | A1 * | 2/2014 | Jones | 84/297 S |
| 2014/0079957 | A1 * | 3/2014 | Jolk et al. | 428/555 |
| 2014/0150626 | A1 * | 6/2014 | Jolk et al. | 84/297 S |

FOREIGN PATENT DOCUMENTS

| | | | |
|---|---|---|---|
| AT | 501070 | A1 | 6/2006 |
| DE | 20318200 | U1 | 2/2004 |

* cited by examiner

*Primary Examiner* — Robert W Horn
(74) *Attorney, Agent, or Firm* — Scully, Scott, Murphy & Presser, P.

(57) ABSTRACT

The invention relates in particular to a musical instrument string. The musical instrument string comprises a core, produced from a metal material, with a coating. The coating comprises an intermediate layer made of nickel or a nickel alloy applied to the core and a sheathing layer made of tin or a tin alloy applied to the intermediate layer.

20 Claims, 1 Drawing Sheet

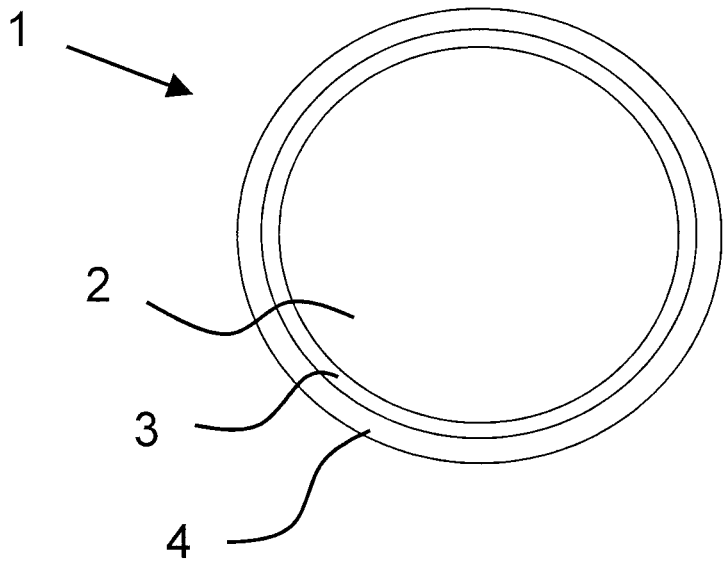
1
2
3
4

MUSICAL INSTRUMENT STRING AND PROCESS FOR THE PRODUCTION THEREOF

BACKGROUND OF THE INVENTION

The present invention relates in particular to a musical instrument string, i.e. a string for musical instruments, in particular for string-based bowed instruments, plucked instruments and percussion instruments, for example guitars etc.

DISCUSSION OF THE PRIOR ART

It is known to produce musical instrument strings inter alia also from metal, e.g. steel wire. Such musical instrument strings in particular are subject to corrosion without further measures.

Particularly for maintaining the playability of a stringed musical instrument, it is desirable to avoid or to suppress corrosion-induced changes to the musical instrument strings at least to the greatest possible extent.

To this end, it is already known to protect the musical instrument strings based on steel materials from corrosion using a coating made of tin. However, this measure affords only limited protection against corrosion, in particular in the case of musical instruments such as guitars, in which the strings are touched when music is being played and are exposed to sweat, moisture, etc. In this respect, it is desirable to further improve the corrosion protection for metal-based musical instrument strings.

SUMMARY OF THE INVENTION

It is an object of the invention to eliminate the disadvantages according to the prior art. In particular, the intention is to make it possible to improve the corrosion protection for musical instrument strings. In this context, the intention is to provide in particular a musical instrument string having improved corrosion protection and also a process for producing a corresponding musical instrument string.

According to the present invention, provision is made of a musical instrument string comprising a core, produced from a metal material, in particular from a steel material, e.g. steel wire, with a coating, in particular an anti-corrosion coating.

The coating comprises an intermediate layer made of nickel or a nickel alloy, i.e. an alloy containing the element nickel, applied to or deposited on or placed on the core.

The coating further comprises a sheathing layer, which is deposited on or applied to or placed on the intermediate layer. The sheathing layer is provided in particular in such a manner that the intermediate layer is covered or concealed, such that the intermediate layer is not freely accessible or exposed from the surface of the musical instrument string. The sheathing layer is produced from tin or a tin alloy.

Here, it is to be noted that the term "musical instrument string" is also to be understood as meaning semifinished products, such as wires produced for producing individual strings, in particular endless wires, and string blanks which also require a further machining or processing step for use on the instrument. The musical instrument string can be, for example, a string or a corresponding semifinished product for bowed instruments or plucked instruments, for example guitars.

Compared to conventional musical instrument strings, the musical instrument string in accordance with the present invention shows considerably reduced corrosion. Even if the musical instrument string is exposed to moisture, sweat, grease or other substances during use, i.e. when music is being played, the corrosion on the string can be delayed at least over a considerably longer period of time.

Corrosion impairs the playability and usability of a musical instrument string, and an exchange of a corroded musical instrument string is regularly necessary.

In addition to reduced corrosion, the proposed coating furthermore provides the advantage of a higher or improved abrasion resistance. This too has a positive effect on the service life or playing life of the musical instrument string.

The proposed coating is suitable in particular as corrosion protection for music strings made of iron materials, in particular for iron and steel wires.

According to one configuration, the intermediate layer of the musical instrument string can have a layer thickness of between 0.2 μm and 5 μm preferably between 0.5 μm and 2 μm, particularly preferably of approximately 1 μm. Such layer thicknesses have proved to be advantageous and also sufficient for the intermediate layer.

According to a further configuration, it is provided that the sheathing layer has a layer thickness of between 0.2 μm and 6 μm, preferably between 0.5 μm and 4 μm, particularly preferably of approximately 1 μm. Such layer thicknesses have proved to be advantageous particularly with a view to reduced corrosion and the strength of the coating. In addition, said layer thicknesses have proved to be particularly suitable in particular as a compromise between effective corrosion protection and low production costs. Anti-corrosion coatings which make effective and long-lasting corrosion protection possible arise in combination with the aforementioned layer thicknesses for the intermediate layer.

According to a further configuration, the sheathing layer is a multiple layer having a plurality of partial layers, in particular a double layer, wherein each partial layer is preferably produced from tin or a tin alloy.

The respective partial layers can be applied, deposited or placed on by the same or different processes. By way of example, a first partial layer located on the intermediate layer can be electrodeposited, whereas a second partial layer applied to the first partial layer can be produced by placing on or applying molten tin.

As has been found, the efficiency of the corrosion protection and the hardness of the coating can be improved with multiple layers, in particular given otherwise identical conditions.

Improvements in the anti-corrosion action can also be achieved if a heat treatment, i.e. a thermal treatment, is carried out after the sheathing layer has been applied. During the heat treatment, the sheathing layer can be heated, for example, to temperatures of between 100° C. and 400° C., in particular for periods of time of 10 ms to 10 s. The heat treatment can be carried out in such a way that the sheathing layer melts. However, melting of the sheathing layer is not absolutely necessary.

According to a further configuration, the coating is embodied in such a manner that the musical instrument string does not exhibit any corrosion-induced discolourations in a corrosion protection test, in which use is preferably made of a moist, sulphur-containing atmosphere, with 10-fold magnification. This means in particular that the coating is embodied in such a manner that, even after the corrosion protection test has been carried out, there are no locations on the surface of the musical instrument string at which corroded points of the core are visible with 10-fold magnification. The proposed musical instrument string has a particularly advantageous corrosion resistance and therefore longevity.

The present invention is further directed to a process for producing a musical instrument string, comprising the following steps:

providing a core produced from a metal material, in particular an iron material, coating the core with an intermediate layer made of nickel or a nickel alloy; and coating the intermediate layer with a sheathing layer made of tin or a tin alloy.

A musical instrument string produced by the stated process has a particularly advantageous corrosion resistance. For further advantages, reference is made to the above statements.

In one configuration of the production process, the intermediate layer is applied to the core in a chemical or electrochemical process. The material of the sheathing layer can be applied to the intermediate layer by means of a chemical or electrochemical process or in a molten state.

In one variant of the production process, the sheathing layer can be produced or applied as a multiple layer, where in this case a plurality of, in particular two, partial layers each made of tin or a tin alloy are deposited, applied or placed on in succession.

After the sheathing layer has been applied, it can be subjected to a heat treatment in a further process step. During the heat treatment, the sheathing layer is preferably heated to temperatures of 100° C. to 400° C., preferably for a period of time in the range of 10 ms to 10 s.

According to an advantageous variant, the coating is applied by the production process in such a manner that, in a corrosion test and with 10-fold magnification, the coating does not exhibit any corrosion-induced discolourations by the core or the coating. The coating is preferably applied in such a manner that, in an in particular warm, moist, sulphur-containing and/or acidic atmosphere, it does not exhibit any discolourations which are visible with 10-fold magnification. The music string, in particular the coating, can be exposed to said atmosphere for a period of time in the region of 24 h, for example, during the corrosion test.

BRIEF DESCRIPTION OF THE DRAWINGS

Exemplary embodiments of the invention will be described in more detail hereinbelow with reference to the figure, which shows a cross section through a musical instrument string.

FIG. 1 shows a cross section through a musical instrument string 1 formed according to the present invention.

DETAILED DESCRIPTION OF THE INVENTION

The musical instrument string 1 comprises a core 2, which is preferably produced from a steel material. Heat-treated steel wire can be used, for example, for the core.

The musical instrument string 1 comprises a coating, which in the present case comprises an intermediate layer 3 made of nickel or a nickel alloy and a sheathing layer 4 made of tin or a tin alloy.

The intermediate layer 3 preferably has a layer thickness, or a mean layer thickness, of 0.2 μm to 5 μm, in particular of approximately 1 μm. The sheathing layer preferably has a layer thickness, or mean layer thickness, of 0.2 μm to 6 μm, in particular of approximately 1 μm.

In the present exemplary embodiment, the sheathing layer 4 is formed as an individual layer. However, it is also possible to form the sheathing layer 4 as a multiple layer, as a result of which in particular the corrosion resistance can be improved. To form a multiple layer, a plurality of partial layers made of tin or a tin alloy can be deposited or applied in succession.

The musical instrument string 1 proposed here is embodied in particular in such a manner that, in a corrosion protection test and with 10-fold magnification, it does not exhibit any corrosion-induced discolourations.

Compared to conventional instrument strings made of metal, the proposed musical instrument string 1 has a considerably improved corrosion resistance, as a result of which the average playing life can advantageously be increased considerably.

The process for producing the musical instrument string 1 will be described in more detail hereinbelow. The basis for the production process is formed initially by the core 2, which can be, for example, a steel wire. The steel wire will be or is thermally and mechanically pretreated according to the requirements of a musical instrument string.

Before the coating is applied, the steel wire, that is the core 2, is chemically pretreated, in particular cleaned, in order to remove any substances detrimental to the coating operation and the adhesion of the coating, such as oils and greases, and/or layers, in particular oxidation layers.

After the pretreatment of the core 2 has been completed, it is nickel-plated.

The pretreatment and nickel plating can be carried out, for example, in successive stations in a continuously operating installation.

Particularly in the case of continuously operating installations, the intermediate layer 3 made of nickel can be electrodeposited. The nickel plating can be effected, for example, in a commercially available nickel sulphamate electrolyte.

After the intermediate layer 3 has been applied, it is chemically activated, and, in a subsequent step, the sheathing layer 4 is deposited, in particular electrodeposited, which can likewise be effected in a or the same continuously operating installation.

Alternatively, the tin or the tin alloy forming the sheathing layer 4 could be applied in molten form, in which case, after the nickel layer has been applied and activated, the wire is pulled through a trough containing liquid tin or a liquid tin alloy and the tin or the tin alloy adhering to the wire is stripped off according to the desired layer thickness. In a subsequent step, the tin or tin alloy layer applied in molten form can be cooled.

To increase the hardness of the coating, a further layer made of molten tin or a molten alloy can be applied to an existing tin or tin alloy layer. In this case, the sheathing layer 4 comprises two partial layers.

Likewise for increasing the hardness of the coating, the sheathing layer 4 made of tin or a tin alloy can in particular be subjected to a heat treatment. In this process, the coating, in particular the sheathing layer 4, can be heated to, for example, 400° C. During the heat treatment, the sheathing layer 4 may melt. However, melting is not absolutely necessary.

The coating steps described above can be followed by yet further process steps for finishing the musical instrument string according to respective requirements.

The efficiency of the coating can be tested in a corrosion protection test, which can proceed as described below, for example.

A sample of the musical instrument string produced as described above is exposed to an acidic and sulphur-containing atmosphere during the corrosion protection test. For this purpose, 40 mg of sodium thiosulphate and 1 ml of 0.25%-strength sulphuric acid are mixed in laboratory glassware. This is followed directly by the transfer of the laboratory glassware together with the sample into an airtight container, in particular a plastic container. The container is then stored for a period of 24 h at a temperature of 50° C. A hot and humid, sulphur-containing, acidic and aggressive atmosphere preferably forms. After the 24 hours have passed, the sample is examined for possible discolourations under a microscope with 10-fold magnification.

Given a damaged or faulty coating, for instance given cracks, gaps or holes in the coating, the atmosphere created in the container in particular causes corrosion and discolouration on the core 2 in the region of the damaged sites of the coating. The corroded points on the surface can be identified by the discolouration. Visible sites with discolourations therefore indicate a damaged or faulty coating.

By contrast, in the test employed here, the coating is considered effective if no discolourations are visible on the sample with 10-fold magnification, or if the sample is free from discolourations. Compared to conventional strings, corresponding musical instrument strings have a considerably improved corrosion protection.

What is claimed is:

1. A musical instrument string comprising a core, produced from a metal material, with a coating which comprises an intermediate layer made of nickel or a nickel alloy applied to the core and a sheathing layer made of tin or a tin alloy applied to the intermediate layer.

2. The musical instrument string according to claim 1, wherein the intermediate layer has a layer thickness of between 0.2 μm and 5 μm.

3. The musical instrument string according to claim 1, wherein the intermediate layer has a layer thickness of between 0.5 μm and 2 μm.

4. The musical instrument string according to claim 1, wherein the intermediate layer has a layer thickness of approximately 1 μm.

5. The musical instrument string according to claim 1, wherein the sheathing layer has a layer thickness of between 0.2 μm and 6 μm.

6. The musical instrument string according to claim 1, wherein the sheathing layer has a layer thickness of between 0.5 μm and 4 μm.

7. The musical instrument string according to claim 1, wherein the sheathing layer has a layer thickness of approximately 1 μm.

8. The musical instrument string according to claim 1, wherein the sheathing layer is a multiple layer.

9. The musical instrument string according to claim 8, wherein said multiple layer is a double layer.

10. The musical instrument string according to claim 8, wherein each partial layer of the multiple layer is produced from tin or a tin alloy.

11. The musical instrument string according to claim 1, wherein the coating is embodied in such a manner that the musical instrument string does not exhibit any corrosion-induced discolourations in a corrosion protection test.

12. The musical instrument string according to claim 11, wherein said corrosion protection test uses a moist, sulphur-containing atmosphere, with 10-fold magnification.

13. A process for producing a musical instrument string according to claim 1, comprising:

providing a core produced from a metal material, coating the core with an intermediate layer made of nickel or a nickel alloy; and coating the intermediate layer with a sheathing layer made of tin or a tin alloy.

14. The process according to claim 13, wherein said core is produced from an iron material.

15. The process according to claim 13, wherein the intermediate layer is applied to the core in a chemical or electrochemical process, and wherein the material of the sheathing layer is applied to the intermediate layer in a chemical or electrochemical process or in a molten state.

16. The process according to claim 6, wherein the sheathing layer is produced as a multiple layer by depositing a plurality of partial layers each made of tin or a tin alloy in succession.

17. The process according to claim 16, wherein said plurality of partial layers comprises two layers.

18. The process according to claim 6, wherein at least the sheathing layer is subjected to a heat treatment.

19. The process according to claim 18, wherein said heat treatment comprises heating the sheathing layer to a temperature of 100° C. to 400° C., for a period of time of 10 ms to 10 s.

20. The process according to claim 6, wherein the coating is applied in such a manner that, in a corrosion test and with 10-fold magnification, it does not exhibit any corrosion-induced discolourations by the coating or the cores.

* * * * *